US009129593B2

(12) United States Patent
Ojala

(10) Patent No.: US 9,129,593 B2
(45) Date of Patent: Sep. 8, 2015

(54) MULTI CHANNEL AUDIO PROCESSING

(75) Inventor: Pasi Sakari Sakari Ojala, Kirkkonummi (FI)

(73) Assignee: Nokia Technologies Oy, Espoo (FI)

( * ) Notice: Subject to any disclaimer, the term of this patent is extended or adjusted under 35 U.S.C. 154(b) by 573 days.

(21) Appl. No.: 12/776,900

(22) Filed: May 10, 2010

(65) Prior Publication Data

US 2011/0123031 A1 May 26, 2011

(51) Int. Cl.
*G10L 19/008* (2013.01)
*G10L 25/12* (2013.01)

(52) U.S. Cl.
CPC ..... *G10L 19/008* (2013.01); *G10L 25/12* (2013.01)

(58) Field of Classification Search
CPC ..... G10L 19/008; G10L 25/12; G10L 19/20; H04S 7/30; H04S 2420/03
USPC ..... 381/5, 27, 48, 80, 85, 117, 17, 19–23; 704/500, 503; 386/239
See application file for complete search history.

(56) References Cited

U.S. PATENT DOCUMENTS

| | | | | |
|---|---|---|---|---|
| 8,223,959 | B2 * | 7/2012 | Grasley et al. | 379/406.1 |
| 8,355,509 | B2 * | 1/2013 | Faller | 381/22 |
| 2005/0182996 | A1 * | 8/2005 | Bruhn | 714/752 |
| 2006/0190247 | A1 | 8/2006 | Lindblom | |
| 2007/0291951 | A1 * | 12/2007 | Faller | 381/22 |
| 2008/0002842 | A1 * | 1/2008 | Neusinger et al. | 381/119 |
| 2008/0114606 | A1 | 5/2008 | Ojala et al. | |
| 2009/0034704 | A1 * | 2/2009 | Ashbrook et al. | 379/142.04 |
| 2009/0222272 | A1 * | 9/2009 | Seefeldt et al. | 704/500 |
| 2009/0238371 | A1 * | 9/2009 | Rumsey et al. | 381/58 |
| 2010/0100372 | A1 | 4/2010 | Zhou et al. | |
| 2011/0022402 | A1 * | 1/2011 | Engdegard et al. | 704/501 |
| 2012/0314879 | A1 * | 12/2012 | Faller | 381/23 |

FOREIGN PATENT DOCUMENTS

| | | | |
|---|---|---|---|
| EP | 0831458 | A2 | 3/1998 |
| EP | 2 209 114 | A1 | 7/2010 |
| TW | 200729708 | A | 8/2007 |
| TW | 200910328 | A | 3/2009 |
| WO | 0223528 | A1 | 3/2002 |
| WO | 2005083679 | A1 | 9/2005 |
| WO | WO 2005/101370 | A | 10/2005 |

(Continued)

OTHER PUBLICATIONS

International Search Report and Written Opinion, received in corresponding Patent Cooperation Treaty Application No. PCT/IB2010/001054, Dated Sep. 9, 2010, 14 pages.

Baumgarte, Frank., et al. "Binaural Cue Coding—Part II: Schemes and Applications", IEEE Transactions on Speech and Audio Processing, Nov. 1, 2003, ISSN 1063-6676: p. 521, col. 1, line 24-line 47.

(Continued)

*Primary Examiner* — Fan Tsang
*Assistant Examiner* — Eugene Zhao
(74) *Attorney, Agent, or Firm* — Harrington & Smith

(57) ABSTRACT

A method includes receiving at least a first input audio channel and a second input audio channel, and using an inter-channel prediction model to form at least one inter-channel parameter. The first and second input audio channels represent a spatial audio image of an acoustic space. The inter-channel prediction model is a linear prediction model representing a predicted sample of the first input audio channel using a weighted linear combination of samples of the second input audio channel. An apparatus for practicing the method and a corresponding computer program product are also disclosed.

28 Claims, 5 Drawing Sheets

(56) References Cited

FOREIGN PATENT DOCUMENTS

| | | | |
|---|---|---|---|
| WO | 2006091139 | A1 | 8/2006 |
| WO | 2006091150 | A1 | 8/2006 |
| WO | WO-2006/091150 | A1 | 8/2006 |
| WO | WO 2007/037613 | A1 | 4/2007 |
| WO | WO 2009/038512 | A1 | 3/2009 |
| WO | WO 2009/068087 | A | 6/2009 |

OTHER PUBLICATIONS

Samsudin., et al. "A Stereo to Mono Downmixing Scheme for MPEG-4 Parametric Stereo Encoder", IEEE International Conference on Acoustics, Speech and Signal Processing, May 14-19, 2006, ISBN 978-1-4244-0469-8, ISBN 1-4244-0469-X, p. 530, col. 1, line 14-line 18.

* cited by examiner

MULTI CHANNEL AUDIO PROCESSING

FIELD OF THE INVENTION

Embodiments of the present invention relate to multi channel audio processing. In particular, they relate to audio signal analysis, encoding and/or decoding multi channel audio.

BACKGROUND TO THE INVENTION

Multi channel audio signal analysis is used for example in multi-channel, audio context analysis regarding the direction and motion as well as number of sound sources in the 3D image, audio coding, which in turn may be used for coding, for example, speech, music etc.

Multi-channel audio coding may be used, for example, for Digital Audio Broadcasting, Digital TV Broadcasting, Music download service, Streaming music service, Internet radio, teleconferencing, transmission of real time multimedia over packet switched network (such as Voice over IP, Multimedia Broadcast Multicast Service (MBMS) and Packet-switched streaming (PSS))

BRIEF DESCRIPTION OF VARIOUS EMBODIMENTS OF THE INVENTION

According to various, but not necessarily all, embodiments of the invention there is provided a method comprising: receiving at least a first input audio channel and a second input audio channel; and using an inter-channel prediction model to form at least one inter-channel parameter.

A computer program which when loaded into a processor may control the processor to perform this method.

According to various, but not necessarily all, embodiments of the invention there is provided a computer program product comprising machine readable instructions which when loaded into a processor control the processor to:

receive at least a first input audio channel and a second input audio channel; and use an inter-channel prediction model to form at least one inter-channel parameter.

According to various, but not necessarily all, embodiments of the invention there is provided an apparatus comprising: means for receiving at least a first input audio channel and a second input audio channel; and means for using an inter-channel prediction model to form at least one inter-channel parameter.

BRIEF DESCRIPTION OF THE DRAWINGS

For a better understanding of various examples of embodiments of the present invention reference will now be made by way of example only to the accompanying drawings in which.

DETAILED DESCRIPTION OF VARIOUS EMBODIMENTS OF THE INVENTION

The illustrated multichannel audio encoder apparatus 4 is, in this example, a parametric encoder that encodes according to a defined parametric model making use of multi channel audio signal analysis.

The parametric model is, in this example, a perceptual model that enables lossy compression and reduction of bandwidth.

The encoder apparatus 4, in this example, performs spatial audio coding using a parametric coding technique, such as binaural cue coding (BCC) parameterisation. Parametric audio coding models in general represent the original audio as a downmix signal comprising a reduced number of audio channels formed from the channels of the original signal, for example as a monophonic or as two channel (stereo) sum signal, along with a bit stream of parameters describing the spatial image. A downmix signal comprising more than one channel can be considered as several separate downmix signals.

The parameters may comprise an inter-channel level difference (ILD) and an inter-channel time difference (ITD) parameters estimated within a transform domain time-frequency slot, i.e. in a frequency sub-band for an input frame.

In order to preserve the spatial audio image of the input signal, it is important that the parameters are accurately determined.

Figure 1:
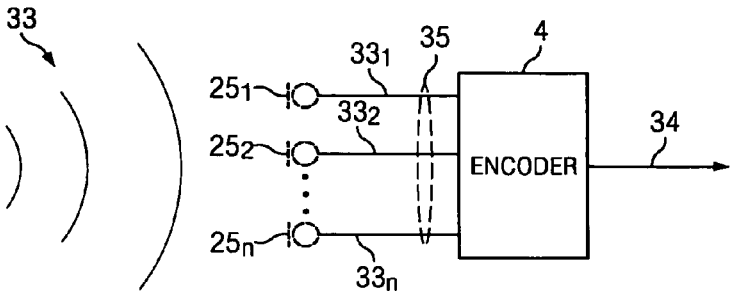
FIG. 1 schematically illustrates a system for multi-channel audio coding.

FIG. 1 schematically illustrates a system 2 for multi-channel audio coding. Multi-channel audio coding may be used, for example, for Digital Audio Broadcasting, Digital TV Broadcasting, Music download service, Streaming music service, Internet radio, conversational applications, teleconferencing etc.

A multi channel audio signal 35 may represent an audio image captured from a real-life environment using a number of microphones 25*n* that capture the sound 33 originating from one or multiple sound sources within an acoustic space. The signals provided by the separate microphones represent separate channels 33*n* in the multi-channel audio signal 35. The signals are processed by the encoder 4 to provide a condensed representation of the spatial audio image of the acoustic space. Examples of commonly used microphone set-ups include multi channel configurations for stereo (i.e. two channels), 5.1 and 7.2 channel configurations. A special case is a binaural audio capture, which aims to model the human hearing by capturing signals using two channels 331, 332 corresponding to those arriving at the eardrums of a (real or virtual) listener. However, basically any kind of multi-microphone set-up may be used to capture a multi channel audio signal. Typically, a multi channel audio signal 35 captured using a number of microphones within an acoustic space results in multi channel audio with correlated channels.

A multi channel audio signal 35 input to the encoder 4 may also represent a virtual audio image, which may be created by combining channels 33*n* originating from different, typically uncorrelated, sources. The original channels 33*n* may be single channel or multi-channel. The channels of such multi channel audio signal 35 may be processed by the encoder 4 to exhibit a desired spatial audio image, for example by setting original signals in desired "location(s)" in the audio image.

Figure 2:
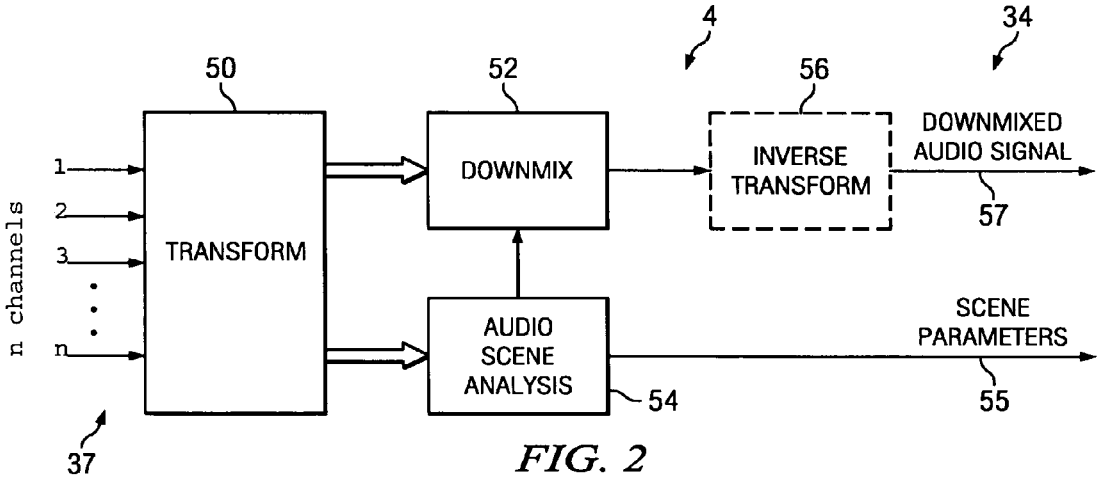
FIG. 2 schematically illustrates a encoder apparatus.

FIG. 2 schematically illustrates a encoder apparatus 4

The illustrated multichannel audio encoder apparatus 4 is, in this example, a parametric encoder that encodes according to a defined parametric model making use of multi channel audio signal analysis.

The parametric model is, in this example, a perceptual model that enables lossy compression and reduction of bandwidth.

The encoder apparatus 4, in this example, performs spatial audio coding using a parametric coding technique, such as binaural cue coding (BCC) parameterisation. Generally parametric audio coding models such as BCC represent the original audio as a downmix signal comprising a reduced number of audio channels formed from the channels of the original signal, for example as a monophonic or as two channel (stereo) sum signal, along with a bit stream of parameters describing the spatial image. A downmix signal comprising more than one channel can be considered as several separate downmix signals.

A transformer 50 transforms the input audio signals (two or more input audio channels) from time domain into frequency domain using for example filterbank decomposition over discrete time frames. The filterbank may be critically sampled. Critical sampling implies that the amount of data (samples per second) remains the same in the transformed domain.

The filterbank could be implemented for example as a lapped transform enabling smooth transients from one frame to another when the windowing of the blocks, i.e. frames, is conducted as part of the subband decomposition. Alternatively, the decomposition could be implemented as a continuous filtering operation using e.g. FIR filters in polyphase format to enable computationally efficient operation.

Channels of the input audio signal are transformed separately to frequency domain, i.e. in a frequency sub-band for an input frame time slot. The input audio channels are segmented into time slots in the time domain and sub bands in the frequency domain.

The segmenting may be uniform in the time domain to form uniform time slots e.g. time slots of equal duration. The segmenting may be uniform in the frequency domain to form uniform sub bands e.g. sub bands of equal frequency range or the segmenting may be non-uniform in the frequency domain to form a non-uniform sub band structure e.g. sub bands of different frequency range. In some implementations the sub bands at low frequencies are narrower than the sub bands at higher frequencies.

From perceptual and psychoacoustical point of view a sub band structure close to ERB (equivalent rectangular bandwidth) scale is preferred. However, any kind of sub band division can be applied.

An output from the transformer 50 is provided to audio scene analyser 54 which produces scene parameters 55. The audio scene is analysed in the transform domain and the corresponding parameterisation 55 is extracted and processed for transmission or storage for later consumption.

Figure 3:
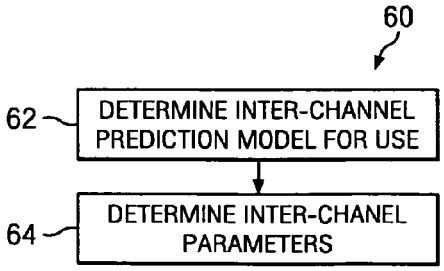
FIG. 3 schematically illustrates a method for determining one or more inter-channel parameters.

The audio scene analyser 54 uses an inter-channel prediction model to form inter-channel parameters 55. This is schematically illustrated in FIG. 3 and described in detail below. The inter-channel parameters may, for example, comprise inter-channel level difference (ILD) and inter-channel time difference (ITD) parameters estimated within a transform domain time-frequency slot, i.e. in a frequency sub-band for an input frame. In addition, the inter-channel coherence (ICC) for a frequency sub-band for an input frame between selected channel pairs may be determined Typically, ILD, ITD and ICC parameters are determined for each time-frequency slot of the input signal, or a subset of time-frequency slots. A subset of time-frequency slots may represent for example perceptually most important frequency components, (a subset of) frequency slots of a subset of input frames, or any subset of time-frequency slots of special interest. The perceptual importance of inter-channel parameters may be different from one time-frequency slot to another. Furthermore, the perceptual importance of inter-channel parameters may be different for input signals with different characteristics. As an example, for some input signals ITD parameter may be a spatial image parameter of special importance.

The ILD and ITD parameters may be determined between an input audio channel and a reference channel, typically between each input audio channel and a reference input audio channel. The ICC is typically determined individually for each channel compared to reference channel In the following, some details of the BCC approach are illustrated using an example with two input channels L, R and a single downmix signal. However, the representation can be generalized to cover more than two input audio channels and/or a configuration using more than one downmix signal.

A downmixer 52 creates downmix signal(s) as a combination of channels of the input signals. The parameters describing the audio scene could also be used for additional processing of multi-channel input signal prior to or after the downmixing process, for example to eliminate the time difference between the channels in order to provide time-aligned audio across input channels.

The downmix signal is typically created as a linear combination of channels of the input signal in transform domain. For example in a two-channel case the downmix may be created simply by averaging the signals in left and right channels:

$$S_n = \frac{1}{2}(S_n^L + S_n^R)$$

There are also other means to create the downmix signal. In one example the left and right input channels could be weighted prior to combination in such a manner that the energy of the signal is preserved. This may be useful e.g. when the signal energy on one of the channels is significantly lower than on the other channel or the energy on one of the channels is close to zero.

An optional inverse transformer 56 may be used to produce downmixed audio signal 57 in the time domain.

Alternatively the inverse transformer 56 may be absent. The output downmixed audio signal 57 is consequently encoded in the frequency domain The output of a multi-channel or binaural encoder typically comprises the encoded downmix audio signal or signals 57 and the scene parameters 55 This encoding may be provided by separate encoding blocks (not illustrated) for signal 57 and 55. Any mono (or stereo) audio encoder is suitable for the downmixed audio signal 57, while a specific BCC parameter encoder is needed for the inter-channel parameters 55. The inter-channel parameters may, for example include one or more of the inter-channel level difference (ILD), and the inter-channel phase difference (ICPD), for example the inter-channel time difference (ITD).

FIG. 3 schematically illustrates a method 60 for determining one or more inter-channel parameters 55.

The method 60 may be performed separately for separate domain time-frequency slots. A domain time-frequency slot has a unique combination of sub-band and input frame time slot.

An inter-channel parameter 55 for a subject audio channel at a subject domain time-frequency slot is determined by comparing a characteristic of the subject domain time-frequency slot for the subject audio channel with a characteristic of the same time-frequency slot for a reference audio channel. The characteristic may, for example, be phase/delay or it may be magnitude.

A sample for audio channel j at time n in a subject sub band may be represented as xj(n).

Historic of past samples for audio channel j at time n in a subject sub band may be represented as xj(n–k), where k>0.

A predicted sample for audio channel j at time n in a subject sub band may be represented as yj(n).

At block 62, an inter-channel prediction model is determined that is suitable for determining at least one inter-channel parameter 55. An example of how the block 62 may be implemented is described in more detail below with reference to FIG. 4.

The inter-channel prediction model represents a predicted sample yj(n) of an audio channel j in terms of a history of an audio channel. The inter-channel prediction model may be an autoregressive model, a moving average model or an autoregressive moving average model etc.

As an example, a first inter-channel prediction model H1 of order L may represent a predicted sample y2 as a weighted linear combination of samples of the input signal x1.

The signal x1 comprises samples from a first input audio channel and the predicted sample y2 represents a predicted sample for the second input audio channel $$Y_2(n) = \sum_{k=0}^{L} H_1(k)x_1(n-k)$$

As another example, the predictor may represent a predicted sample y2 as a combination of a weighted linear combination of samples of the input signal x1 Land a weighted linear combination of samples of the past predicted signal as follows.

$$y_2(n) = \sum_{k=0}^{L} G_1(k)x_1(n-k) + \sum_{k=1}^{N} G_2(k)y_2(n-k)$$

In which case the inter-channel prediction model is $$H_1(k) = \frac{G_1(k)}{1 - G_2(k)}$$

In embodiments of the invention, several inter-channel prediction models may be used in parallel to predict samples of an audio channel. As an example, prediction models of different model order may be employed. As another example, prediction models of different type, such as the two example models described above, may be used. As a yet another example, in case of more than two input signal channels multiple predictors may be used to predict samples of an audio channel on the basis of different input channels Then at block 64 the determined inter-channel prediction model is used to form at least one inter-channel parameter 55. An example of how the block 64 may be implemented is described in more detail below with reference to FIGS. 8 and 9.

Figure 4:
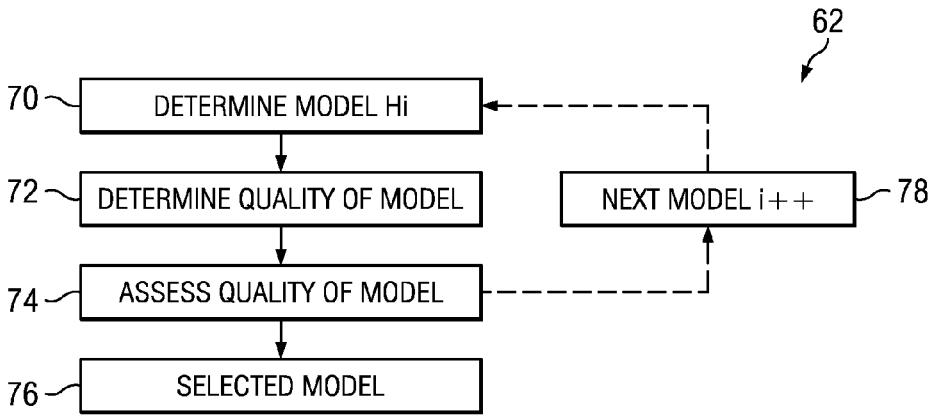
FIG. 4 schematically illustrates an example of a method suitable for determining that an inter-channel prediction model is suitable for determining at least one inter-channel parameter.

FIG. 4 schematically illustrates an example of a method suitable for use in block 62 in which an inter-channel prediction model is determined that is suitable for determining at least one inter-channel parameter 55.

At block 70, a putative inter-channel predictive model is determined. An example of how this block may be implemented is described in more detail below with reference to FIG. 5.

Then at block 72, the quality of the putative inter-channel predictive model is determined. For example, a performance measure of the inter-channel prediction model may be determined.

An example of how the block 72 may be implemented is described in more detail below with reference to FIG. 7.

Then at block 74, the quality of the putative inter-channel predictive model is assessed.

If the putative inter-channel predictive model is suitable for determining at least one inter-channel parameter then the process moves to block 76.

If the putative inter-channel predictive model is not suitable for determining at least one inter-channel parameter the process moves to block 78.

For example, block 74 may test the performance measure against one or more selection criterion and based on the outcome of the test determine whether the putative inter-channel prediction model is suitable for determining at least one inter-channel parameter.

An example of how the block 74 may be implemented is described in more detail below with reference to FIG. 7.

At block 76, the putative inter-channel prediction model is recorded as suitable for determining at least one inter-channel parameter 55.

At block 78, the model index i is increased by one and the process moves to block 70 to determine the next putative inter-channel prediction model Hi.

Figure 5:
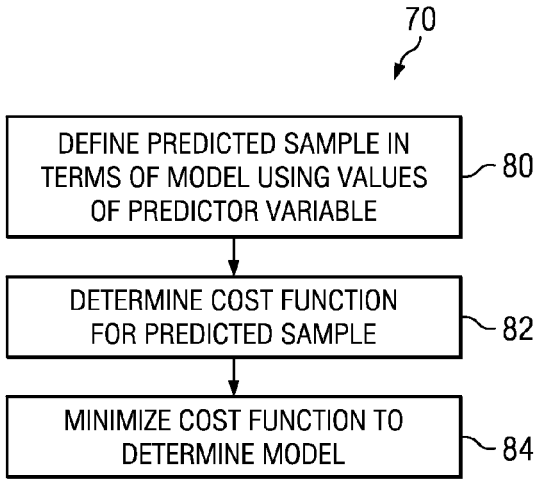
FIG. 5 schematically illustrates a method suitable for determining an inter-channel prediction model.

FIG. 5 schematically illustrates a method suitable for use in block 70 in which an inter-channel prediction model is determined. The inter-channel prediction model may be determined in real time on the fly.

The inter-channel prediction model represents a predicted sample yj(n) of an audio channel j in terms of a history of an audio channel. The inter-channel prediction model may be an autoregressive model, a moving average model or an autoregressive moving average model etc.

At block 80, a predicted sample is defined in terms of inter-channel prediction model using values of a predictor input variables.

Then at block 82, a cost function for the predicted sample is determined.

Figure 6:
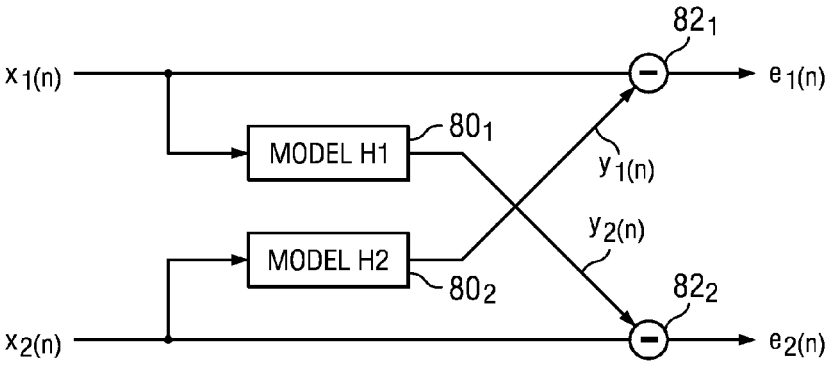
FIG. 6 schematically illustrates how cost functions for different putative inter-channel prediction models H1 and H2 may be determined in some implementations.

The blocks 80 and 82 may be understood better by referring to FIG. 6, which schematically illustrates how cost functions for different putative inter-channel prediction models H1 and H2 may be determined in some implementations.

A first inter-channel prediction model H1 may represent a predicted sample y2 as a weighted linear combination of input signal x1.

The input signal x1 comprises samples from a first input audio channel and the predicted sample y2 represents a predicted sample for the second input audio channel.

$$y_2(n) = \sum_{k=0}^{L} H_1(k)x_1(n-k)$$

Alternatively, the first inter-channel predictor model may represent a predicted sample y2 for example as a combination of a weighted linear combination of samples of the input signal x1. and a weighted linear combination of samples of the past predicted signal as follows.

$$y_2(n) = \sum_{k=0}^{L} G_1(k)x_1(n-k) + \sum_{k=1}^{N} G_2(k)y_2(n-k)$$

In which case the inter-channel prediction model is $$H_1(k) = \frac{G_1(k)}{1 - G_2(k)}$$

The model order (L and N), i.e. the number(s) of predictor coefficients, is greater than the expected inter channel delay. That is, the model should have at least as many predictor coefficients as the expected inter channel delay is in samples. It is advantageous, especially when the expected delay is in sub sample domain, to have slightly higher model order than the delay.

A second inter-channel prediction model H2 may represent a predicted sample y1 as a weighted linear combination of samples of the input signal x2.

The input signal x2 contains samples from the second input audio channel and the predicted sample y1 represents a predicted sample for the first input audio channel.

$$y_1(n) = \sum_{k=0}^{L} H_2(k)x_2(n-k)$$

Alternatively, the second inter-channel predictor model may represent a predicted sample y2 for example as a combination of a weighted linear combination of samples of the input signal x1. and a weighted linear combination of samples of the past predicted signal as follows.

$$y_1(n) = \sum_{k=0}^{L} G_3(k)x_2(n-k) + \sum_{k=1}^{N} G_4(k)y_1(n-k)$$

In which case the prediction model is $$H_2(k) = \frac{G_3(k)}{1 - G_4(k)}$$

The cost function, determined at block 82, may be defined as a difference between the predicted sample y and an actual sample x.

The cost function for the inter-channel prediction model H1 is, in this example:

$$e_2(n) = x_2(n) - y_2(n) = x_2(n) - \sum_{k=0}^{L} H_1(k)x_1(n-k)$$

The cost function for the inter-channel prediction model H2 is, in this example:

$$e_1(n) = x_1(n) - y_1(n) = x_1(n) - \sum_{k=0}^{L} H_2(k)x_2(n-k)$$

At block 84, the cost function for the putative inter-channel prediction model is minimized to determine the putative inter-channel prediction model. This may, for example, be achieved using least squares linear regression analysis.

Figure 7:
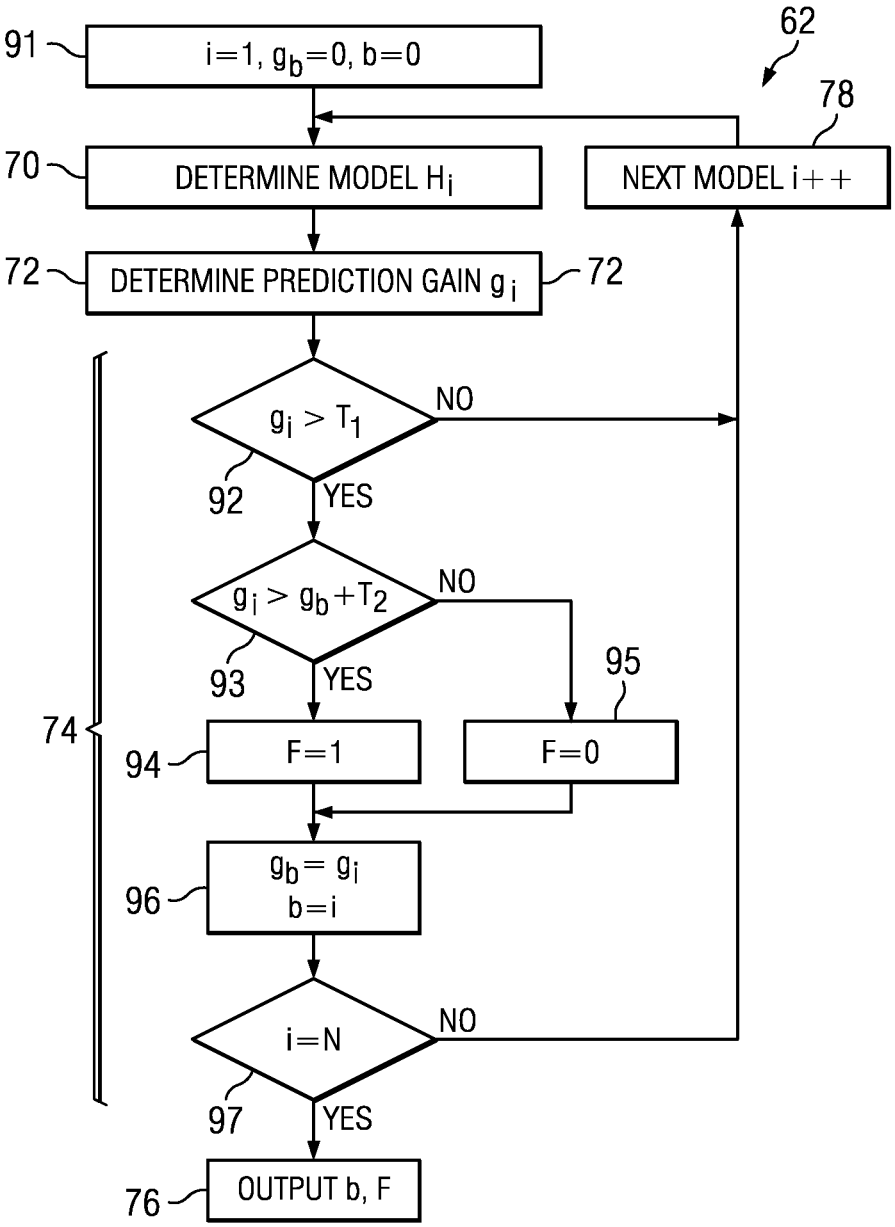
FIG. 7 schematically illustrates a more detailed example of a method suitable for determining that an inter-channel prediction model is suitable for determining at least one inter-channel parameter.

FIG. 7 schematically illustrates an example of a method suitable for use in block 62 in which an inter-channel prediction model is determined that is suitable for determining at least one inter-channel parameter 55. The implementation illustrated in FIG. 7 is, one of many possible ways of implementing the method illustrated in FIG. 4.

At block 91, some initial conditions are set. The model index i is set to 1. The 'best' (so far) model index b is set to a NULL value. The prediction gain gb for the best (so far) model is set to NULL value.

At block 70, a putative inter-channel predictive model Hi is determined. An example of how this block may be implemented has been described in more detail above with reference to FIG. 5.

Then at block 72, the quality of the putative inter-channel predictive model is determined.

For example, a performance measure of the inter-channel prediction model, such as prediction gain gi, may be determined.

The prediction gain gi may be defined as:

$$g_1 = \frac{x_2(n)^T x_2(n)}{e_1(n)^T e_1(n)},$$

$$g_2 = \frac{x_1(n)^T x_1(n)}{e_2(n)^T e_2(n)}.$$

with respect to FIG. 6.

A high prediction gain indicates strong correlation between channels.

Then at block 74, the quality of the putative inter-channel predictive model is assessed. This block is subdivided into a number of sub blocks that test the performance measure against selection criteria.

A first selection criterion may require that the prediction gain gi for the putative inter-channel prediction model Hi is greater than an absolute threshold value T1. At block 92, the prediction gain gi for the putative inter-channel prediction model Hi is tested to determine if it exceeds the threshold T1.

A low prediction gain implies that inter channel correlation is low. Prediction gain values below or close to unity indicate that the predictor does not provide meaningful parameterisation. For example, the absolute threshold may be set at 10 log 10(gi)=10 dB.

If prediction gain gi for the putative inter-channel prediction model Hi does not exceed the threshold, the test is unsuccessful. It is therefore determined that the putative inter-channel prediction model Hi is not suitable for determining at least one inter-channel parameter and the process escapes to block 78.

If prediction gain gi for the putative inter-channel prediction model Hi does exceed the threshold, the test is successful. It is therefore determined that the putative inter-channel prediction model Hi may be suitable for determining at least one inter-channel parameter and the process continues to block 93.

A second selection criterion may require that the prediction gain gi for the putative inter-channel prediction model Hi is greater than a relative threshold value T2. At block 94, the prediction gain gi for the putative inter-channel prediction model Hi is tested to determine if it exceeds the threshold T2.

The relative threshold value T2 is the current best prediction gain gb plus an offset. The offset value may be any value greater than or equal to zero. In one implementation, the offset is set between 20 dB and 40 dB such as at 30 dB.

If prediction gain gi for the putative inter-channel prediction model Hi does not exceed the threshold, the test is unsuccessful. It is therefore determined that the putative inter-channel prediction model Hi is not suitable for determining at least one inter-channel parameter and the process moves to block 95 where Flag F is set to 0. Flag F=0 indicates that the 'best' putative inter-channel prediction model is not suitable for determining at least one inter-channel parameter. However, the putative inter-channel prediction model Hi has the best (so far) prediction gain gi and therefore the process therefore moves to block 96.

If prediction gain gi for the putative inter-channel prediction model Hi exceeds the threshold, the test is successful. It is therefore determined that the putative inter-channel prediction model Hi is be suitable for determining at least one inter-channel parameter and the process moves to block 94 where Flag F is set to 1. Flag F=1 indicates that the 'best' putative inter-channel prediction model is suitable for determining at least one inter-channel parameter. The process moves to block 96.

At block 96, the putative inter-channel prediction model Hi is recorded as the best (so far) inter-channel predictive model Hb by setting b=i and by setting gb equal to gi.

At block 97, it is checked whether all N of the possible putative inter-channel prediction models Hi have been processed. The value of N may be any natural number greater than or equal to 1. In FIG. 6, N=2.

If there are still more putative inter-channel prediction models Hi to process the process moves to block 78. At block 78, the model index i is increased by one and the process moves to block 70 to determine the next putative inter-channel prediction model Hi.

If there are no more putative inter-channel prediction models Hi to process the process moves to block 76. At block 76, the best inter-channel prediction model Hb is output along with Flag F which indicates whether or not it is suitable for determining at least one inter-channel parameter 55.

Figure 8:
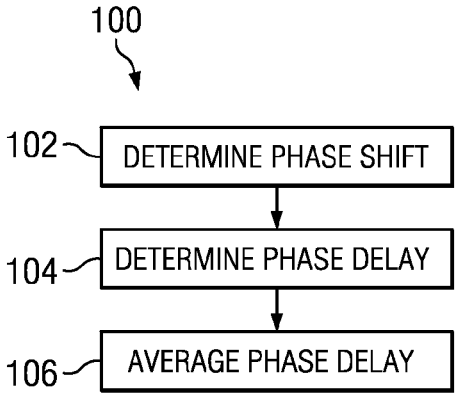
FIG. 8 schematically illustrates a method for determining an inter-channel parameter from the selected inter-channel prediction model Hb.

FIG. 8 schematically illustrates a method 100 for determining an inter-channel parameter from the selected inter-channel prediction model Hb.

At block 102, a phase shift/response of the inter-channel prediction model is determined.

The inter channel time difference is determined from the phase response of the model. When $$H(z) = \sum_{k=0}^{L} b_k z^{-k},$$

the frequency response is determined as $$H(e^{j\omega}) = e^{-j\omega L} \sum_{k=0}^{L} b_k e^{j\omega k}.$$

The phase shift of the model is determined as $$\phi(\omega)=\angle(H(e^{j\omega}))$$

At block 104, the corresponding phase delay of the model is determined:

$$\tau_\phi(\omega) = -\frac{\phi(\omega)}{\omega}.$$

At block 106, an average of) $\tau_\phi(\omega)$ over the whole or subset of the frequency range may be determined.

Since the phase delay analysis is done in sub band domain, a reasonable estimate for the inter channel time difference (delay) within is an average of $\tau_\phi(\omega)$ over the whole or subset of the frequency range.

Figure 9:
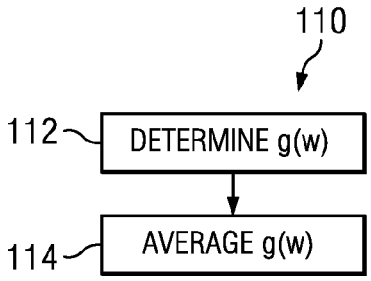
FIG. 9 schematically illustrates a method for determining an inter-channel parameter from the selected inter-channel prediction model Hb.

FIG. 9 schematically illustrates a method 110 for determining an inter-channel parameter from the selected inter-channel prediction model Hb.

At block 112, a magnitude of the inter-channel prediction model is determined.

The level difference inter-channel parameter is determined from the magnitude.

The inter channel level of the model is determined as $$g(\omega)=|H(e^{j\omega})|.$$

Again, the inter channel level difference can be estimated by calculating the average of g(ω) over the whole or subset of the frequency range.

At block 106, an average of g(ω) over the whole or subset of the frequency range may be determined. The average may be used as inter channel level difference parameter.

Figure 10:
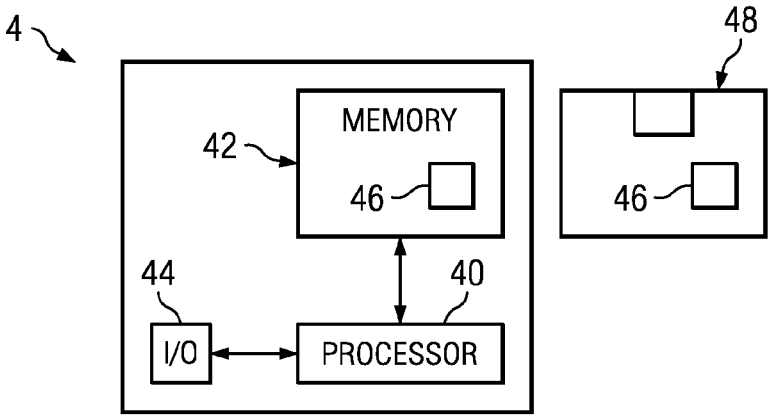
FIG. 10 schematically illustrates components of a coder apparatus that may be used as an encoder apparatus and/or a decoder apparatus.

FIG. 10 schematically illustrates components of a coder apparatus that may be used as an encoder apparatus 4 and/or a decoder apparatus 80. The coder apparatus may be an end-product or a module. As used here 'module' refers to a unit or apparatus that excludes certain parts/components that would be added by an end manufacturer or a user to form an end-product apparatus.

Implementation of a coder can be in hardware alone (a circuit, a processor . . . ), have certain aspects in software including firmware alone or can be a combination of hardware and software (including firmware).

The coder may be implemented using instructions that enable hardware functionality, for example, by using executable computer program instructions in a general-purpose or special-purpose processor that may be stored on a computer readable storage medium (disk, memory etc) to be executed by such a processor.

In the illustrated example an encoder apparatus 4 comprises: a processor 40, a memory 42 and an input/output interface 44 such as, for example, a network adapter.

The processor 40 is configured to read from and write to the memory 42. The processor 40 may also comprise an output interface via which data and/or commands are output by the processor 40 and an input interface via which data and/or commands are input to the processor 40.

The memory 42 stores a computer program 46 comprising computer program instructions that control the operation of the coder apparatus when loaded into the processor 40. The computer program instructions 46 provide the logic and routines that enables the apparatus to perform the methods illustrated in FIGS. 3 to 9. The processor 40 by reading the memory 42 is able to load and execute the computer program 46.

The computer program may arrive at the coder apparatus via any suitable delivery mechanism 48. The delivery mechanism 48 may be, for example, a computer-readable storage medium, a computer program product, a memory device, a record medium such as a CD-ROM or DVD, an article of manufacture that tangibly embodies the computer program 46. The delivery mechanism may be a signal configured to reliably transfer the computer program 46. The coder apparatus may propagate or transmit the computer program 46 as a computer data signal.

Although the memory 42 is illustrated as a single component it may be implemented as one or more separate components some or all of which may be integrated/removable and/or may provide permanent/semi-permanent/dynamic/cached storage.

References to 'computer-readable storage medium', 'computer program product', 'tangibly embodied computer program' etc. or a 'controller', 'computer', 'processor' etc. should be understood to encompass not only computers having different architectures such as single/multi-processor architectures and sequential (Von Neumann)/parallel architectures but also specialized circuits such as field-programmable gate arrays (FPGA), application specific circuits (ASIC), signal processing devices and other devices. References to computer program, instructions, code etc. should be understood to encompass software for a programmable processor or firmware such as, for example, the programmable content of a hardware device whether instructions for a processor, or configuration settings for a fixed-function device, gate array or programmable logic device etc.

Decoding

Figure 11:
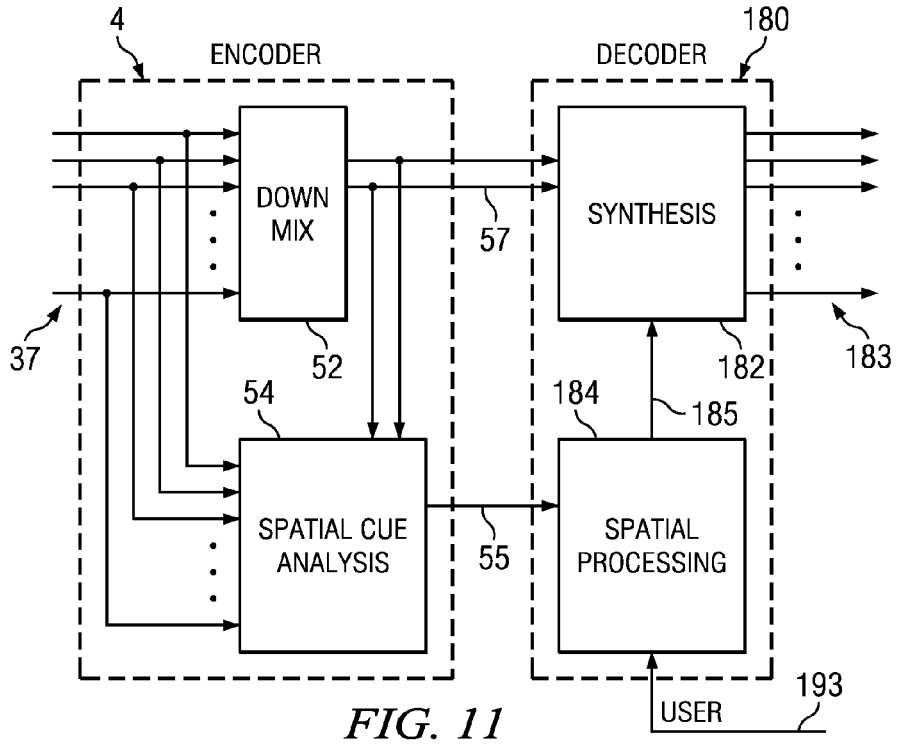
FIG. 11 schematically illustrates a decoder apparatus which receives input signals from the encoder apparatus.

FIG. 11 schematically illustrates a decoder apparatus 180 which receives input signals 57, 55 from the encoder apparatus 4.

The decoder apparatus 180 comprises a synthesis block 182 and a parameter processing block 184. The signal synthesis, for example BCC synthesis, may occur at the synthesis block 182 based on parameters provided by the parameter processing block 184.

A frame of downmixed signal(s) 57 consisting of N samples $s_0, \ldots, s_{N-1}$ is converted to N spectral samples $S_0, \ldots, S_{N-1}$ e.g. with DTF transform.

Inter-channel parameters (BCC cues) 55, for example ILD and ITD described above, are output from the parameter processing block 184 and applied in the synthesis block 182 to create spatial audio signals, in this example binaural audio, in a plurality (N) of output audio channels 183.

When the downmix for two-channel signal is created according to the equation above, and the ILD $\Delta L_n$ is determined as the level difference of left and right channel, the left and right output audio channel signals may be synthesised for subband n as follows $$S_n^L = \frac{1}{2}\frac{\Delta L_n}{\Delta L_n + 1} S_n e^{-j\frac{2\pi n \tau_n}{2N}}$$

$$S_n^R = \frac{1}{2}\frac{1}{\Delta L_n + 1} S_n e^{j\frac{2\pi n \tau_n}{2N}},$$

where $S_n$ is the spectral coefficient vector of the reconstructed downmixed signal, $S_n^L$ and $S_n^R$ are the spectral coefficients of left and right binaural signal, respectively.

It should be noted that the synthesis using frequency dependent level and delay parameters recreates the sound components representing the audio sources. The ambience may still be missing and it may be synthesised using the coherence parameter.

A method for synthesis of the ambient component based on the coherence cue consists of decorrelation of a signal to create late reverberation signal. The implementation may consist of filtering output audio channels using random phase filters and adding the result into the output. When a different filter delays are applied to output audio channels, a set of decorrelated signals is created.

Figure 12:
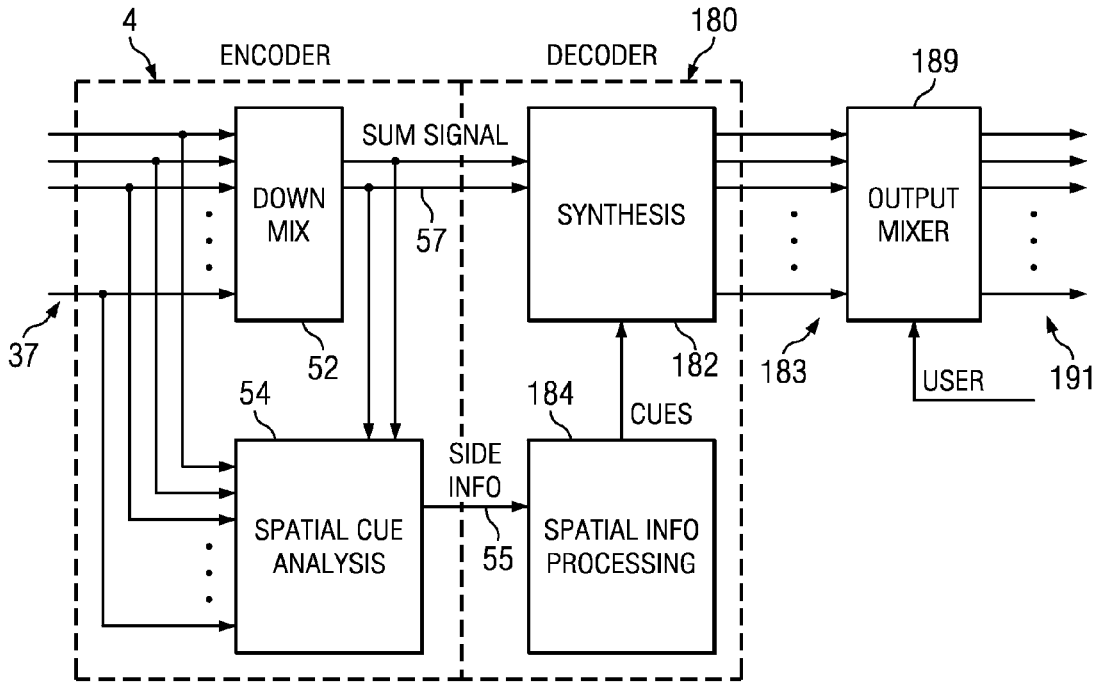
FIG. 12 schematically illustrates a decoder in which the multi-channel output of the synthesis block is mixed, into a plurality of output audio channels.

FIG. 12 schematically illustrates a decoder in which the multi-channel output of the synthesis block 182 is mixed, by mixer 189 into a plurality (K) of output audio channels 191.

This allows rendering of different spatial mixing formats. For example, the mixer 189 may be responsive to user input 193 identifying the user's loudspeaker setup to change the mixing and the nature and number of the output audio channels 191. In practice this means that for example a multi-channel movie soundtrack mixed or recorded originally for a 5.1 loudspeaker system, can be upmixed for a more modern 7.2 loudspeaker system. As well, music or conversation recorded with binaural microphones could be played back through a multi-channel loudspeaker setup.

It is also possible to obtain inter-channel parameters by other computationally more expensive methods such as cross correlation. In some embodiments, the above described methodology may be used for a first frequency space and cross-correlation may be used for a second, different, frequency space.

The blocks illustrated in the FIGS. 2 to 9 and 10 and 11 may represent steps in a method and/or sections of code in the computer program 46. The illustration of a particular order to the blocks does not necessarily imply that there is a required or preferred order for the blocks and the order and arrangement of the block may be varied. Furthermore, it may be possible for some steps to be omitted.

Although embodiments of the present invention have been described in the preceding paragraphs with reference to various examples, it should be appreciated that modifications to the examples given can be made without departing from the scope of the invention as claimed. For example, the technology described above may also be applied to the MPEG surround codec Features described in the preceding description may be used in combinations other than the combinations explicitly described.

Although functions have been described with reference to certain features, those functions may be performable by other features whether described or not.

Although features have been described with reference to certain embodiments, those features may also be present in other embodiments whether described or not.

Whilst endeavoring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

The invention claimed is:

1. A method comprising:

receiving at least a first input audio signal representing a first audio channel and a second input audio signal representing a second audio channel, said first and second input audio signals jointly representing a spatial audio image of an acoustic space;

using an inter-channel prediction model between said first and second input audio signals to form at least one inter-channel parameter, said at least one inter-channel parameter being descriptive of a difference between said first and second audio channels, said inter-channel prediction model being a linear prediction model wherein a sample of said first input audio signal is predicted using a weighted linear combination of samples of said second input audio signal;

combining said first and second input audio signals into a downmix signal; and providing an output signal comprising the downmix signal and said at least one inter-channel parameter for use in recreating said spatial audio image.

2. The method as claimed in claim 1, further comprising:

using different inter-channel prediction models for different sub bands.

3. The method as claimed in claim 1, further comprising:

using at least one selection criterion for selecting an inter-channel prediction model for use, wherein the at least one selection criterion is based upon a performance measure of the inter-channel prediction model.

4. The method as claimed in claim 3, wherein the performance measure is prediction gain.

5. The method as claimed in claim 4, wherein one selection criterion requires that the performance measure be greater than a first absolute threshold value.

6. The method as claimed in claim 4, wherein one selection criterion requires that the performance measure is greater than a second relative threshold value dependent upon a performance value for another inter-channel prediction model.

7. The method as claimed in claim 1, further comprising:

selecting an inter-channel prediction model for use from a plurality of inter-channel prediction models.

8. The method as claimed in claim 1, further comprising:

using cross-correlation to determine at least one inter-channel parameter.

9. The method as claimed in claim 1, wherein the inter-channel prediction model represents a predicted sample of an audio channel in terms of a history of an audio channel.

10. The method as claimed in claim 9, further comprising:

minimizing a cost function for the predicted sample to determine an inter-channel prediction model; and using the determined inter-channel prediction model to determine at least one inter-channel parameter.

11. The method as claimed in claim 10, wherein the cost function is a difference between the predicted sample and an actual sample.

12. The method as claimed in claim 1, wherein the inter-channel prediction model is one of an autoregressive model, a moving average model and an autoregressive moving average model.

13. The method as claimed in claim 1, wherein the at least one inter-channel parameter comprises a time difference inter-channel parameter.

14. The method as claimed in claim 13, further comprising:

determining a phase response of the inter-channel prediction model to determine a time difference inter-channel parameter.

15. The method as claimed in claim 1, wherein the at least one inter-channel parameter comprises a level-difference inter-channel parameter.

16. The method as claimed in claim 15, further comprising:

determining magnitude response of the inter-channel prediction model to determine a level-difference inter-channel parameter.

17. The method as claimed in claim 1, further comprising:

providing an output signal comprising a downmixed signal and the at least one inter-channel parameter.

18. A computer program product comprising a non-transitory computer-readable storage medium bearing computer program code embodied therein for use with a processor, the computer program code comprising code for performing the method of claim 1.

19. A computer program product comprising a non-transitory computer-readable storage medium bearing machine readable instructions embodied therein for use with a processor, the machine readable instructions comprising instructions for performing at least the following:

receive at least a first input audio signal representing a first audio channel and a second input audio signal representing a second audio channel, said first and second input audio signals jointly representing a spatial audio image of an acoustic space;

use an inter-channel prediction model between said first and second input audio signals to form at least one inter-channel parameter, said at least one inter-channel parameter being descriptive of a difference between said first and second audio channels, said inter-channel prediction model being a linear prediction model wherein a sample of said first input audio signal is predicted using a weighted linear combination of samples of said second input audio signal;

combine said first and second input audio signals into a downmix signal; and provide an output signal comprising the downmix signal and said at least one inter-channel parameter for use in recreating said spatial audio image.

20. The computer program product as claimed in claim 19, wherein the machine readable instructions further comprise instructions for performing:

use at least one selection criterion for selecting the inter-channel prediction model for use, wherein the at least one selection criterion is based upon a performance measure of the inter-channel prediction model.

21. The computer program product as claimed in claim 20, wherein one selection criterion requires that the performance measure be greater than a threshold value.

22. The computer program product as claimed in claim 19, wherein the machine readable instructions further comprise instructions for performing:

select an inter-channel prediction model for use from a plurality of inter-channel prediction models.

23. The computer program product as claimed in claim 19, wherein the machine readable instructions further comprise instructions for performing:

use cross-correlation to determine at least one inter-channel parameter when no inter-channel prediction model is usable.

24. An apparatus comprising:

one or more processors; and one or more memories including computer program code, the one or more memories and the computer program code configured, with the one or more processors, to cause the apparatus to perform at least the following:

receiving at least a first input audio signal representing a first audio channel and a second input audio signal representing a second audio channel, said first and second input audio signals jointly representing a spatial audio image of an acoustic space;

using an inter-channel prediction model between said first and second input audio signals to form at least one inter-channel parameter, said at least one inter-channel parameter being descriptive of a difference between said first and second audio channels, said inter-channel prediction model is being a linear prediction model wherein a sample of said first input audio signal is predicted using a weighted linear combination of samples of said second input audio signal;

combining said first and second input audio signals into a downmix signal; and providing an output signal comprising the downmix signal and said at least one inter-channel parameter for use in recreating said spatial audio image.

25. The apparatus as claimed in claim 24, wherein the one or more memories and the computer program code are further configured, with the one or more processors, to cause the apparatus to perform:

using at least one selection criterion for selecting an inter-channel prediction model for use, wherein the at least one selection criterion is based upon a performance measure of the inter-channel prediction model.

26. The apparatus as claimed in claim 24, wherein the one or more memories and the computer program code are further configured, with the one or more processors, to cause the apparatus to perform:

selecting an inter-channel prediction model for use from a plurality of inter-channel prediction models.

27. The apparatus as claimed in claim 24, wherein the one or more memories and the computer program code are further configured, with the one or more processors, to cause the apparatus to perform:

using cross-correlation to determine at least one inter-channel parameter when no inter-channel prediction model is usable.

28. The method as claimed in claim 1, further comprising capturing said first and second input audio signals by first and second microphones to capture at least one sound source within said acoustic space.

* * * * *